US005117808A

United States Patent [19]

Peters et al.

[11] Patent Number: 5,117,808

[45] Date of Patent: Jun. 2, 1992

[54] FOLDER BURNER APPARATUS

[76] Inventors: Donald M. Peters, P.O. Box 64, Simpson, La. 71474; Hugh W. Smith, Rte. 2 Box 93A, Anacoco, La. 71403

[21] Appl. No.: 713,292

[22] Filed: Jun. 11, 1991

[51] Int. Cl.[5] ..... F24G 5/04

[52] U.S. Cl. ..... 126/260; 126/9 B; 126/38; 126/25 R

[58] Field of Search ..... 431/343; 126/9 R, 9 B, 126/260, 24, 29, 30, 38, 37 B, 40; 108/122, 38; 248/188.6, 188.7, 528, 167

[56] References Cited

U.S. PATENT DOCUMENTS 4,653,462 3/1987 DeFoe ..... 126/24

*Primary Examiner*—Larry Jones

*Attorney, Agent, or Firm*—John M. Harrison

[57] ABSTRACT

An improved folding burner apparatus which is characterized by three support legs, two of which legs are each provided with a compression leg fitting for pivotally mounting the support legs on a burner pipe in foldable relationship. Each of the leg fittings is further provided with a leg stop which contacts the burner pipe when the legs are deployed, to prevent the legs from folding excessively when the burner apparatus is oriented in functional configuration. The third leg is fixed to a leg collar which is rigidly attached to the burner pipe and serves to stabilize a gas inlet line which terminates inside the bottom area of the burner pipe.

6 Claims, 1 Drawing Sheet

FOLDER BURNER APPARATUS

BACKGROUND OF THE INVENTION

1. Field of the Invention

This invention relates to a folding burner apparatus which is characterized by two pivoting or folding legs, each of which is provided with a compression leg fitting welded in spaced relationship on a central burner pipe. A third leg is fixed in a sleeve or collar welded or otherwise rigidly attached to the burner pipe and spaced from the pivotable legs. The pivoting legs can be quickly and easily deployed in spaced relationship at an angle of about 120° with respect to each other and the fixed leg, in order to support a pot, pan or other utensil or vessel for cooking or heating purposes. When not in use, the two pivoting legs can be folded against each other and the fixed leg for storage, by rotating the pivoting legs in the leg fittings with respect to the burner pipe and the fixed leg. The improved burner apparatus of this invention includes the burner pipe, a gas inlet line extending into the burner pipe, two foldable or pivotable legs pivotally secured to the burner pipe by means of leg fittings, a fixed leg and leg stops secured to each of the pivoting legs to facilitate uniform deployment. A cap provided with a cap orifice of selected size is fitted on the upward-turned end of the gas inlet line projecting inside the burner pipe to create a flame of desired proportions in the burner pipe. In a most preferred embodiment the improved folding burner apparatus of this invention further includes a bottom collar washer which is welded or otherwise attached to the bottom end of the burner pipe to provide a desirable flow of air into the burner pipe and facilitate more optimum operation of the burner apparatus. In another most preferred embodiment of the invention, an inlet line fitting is secured to the gas inlet line in order to secure the gas inlet line in functional position on a gas supply hose (not illustrated) connected to a source of gas such as a butane or propane storage vessel (not illustrated).

2. Description of the Prior Art

Various types of portable folding stoves, burner devices and similar apparatus have been long known in the art. U.S. Pat. No. 3,025,849, dated Mar. 20, 1962, to H. G. Zimmerman, discloses a "Portable Folding Stove" which includes a flat top defined by a pair of concentric rings which are connected by spaced, projecting fingers. Three legs extend downwardly from the outer ring and are foldable, with the ends of the legs supported by receptacles attached to a central burner support located beneath the concentric rings. U.S. Pat. No. 4,192,284, dated Mar. 11, 1980, to Marcel Vache, discloses "Portable Stoves" which are fueled from a replaceable, pressurized, combustible gas cartridge. The gas cartridge is secured inside a cover member supporting a burner head and provided with means for connecting the burner head to the replaceable cartridge. A pair of covers which telescopically fit one into the other, have the dual function of serving separately as sauce pans or in the alternative, as an expandable housing for storing the stove. The covers selectively telescope to a relatively greater or lesser extent in order to store the stove assembly and facilitate use of the stove. Shaped arms are also provided in the stove for use in supporting a pan on the stove. A "Backpackers Stove Apparatus" is disclosed in U.S. Pat. No. 4,284,058, dated Aug. 18, 1981, to William R. Lutz. The stove apparatus of this invention includes a valve burner assembly and a fuel container threaded together in direct connection, with a collapsible pot stand assembly, which includes a wind screen for protecting the flame of the burner. The pot stand assembly, valve burner assembly and fuel container fit together for compact packaging within pans used for cooking. A "Portable Stove" is disclosed in U.S. Pat. No. 4,385,619, dated May 31, 1983, to Dominic L. Casinelli, deceased. The "Portable Stove" is designed to support a stove utensil and heat the utensil with a fuel element and includes a support plate, multiple support legs pivotally mounted to the support plate and a fuel receptacle located within the support plate for receiving the fuel element and heating the stove utensils. Spacer members are also provided in cooperation with the support plate for spacing the stove utensils a predetermined distance from the upper surface of the support plate and proper heating of the utensils. U.S. Pat. No. 4,530,345, dated Jul. 23, 1985, to J. H. Christiansen, discloses a stove for supporting cooking stands and vessels which have rounded or spherical bottoms. This stove is characterized by three spaced uprights having upper ends inclined inwardly toward each other. The three uprights are preferably spaced about a heat source and the upper ends thereof terminate in a single horizontal plane. Another stove or burner apparatus which is known in the art is the burner apparatus characterized by three support legs, each of which legs is provided with a collar for mounting in rotatable fashion on a central burner pipe provided with a gas line and inlet line elbow mounted inside the burner pipe to provide the necessary gas supply. The collars are attached to the respective support legs at different heights between a pair of fixed rings welded to the burner pipe to facilitate mounting the collars in stacked, rotatable relationship on the burner pipe.

One of the problems which is apparent in prior art stoves and burner mechanisms and particularly the burner apparatus of the type having three equally-spaced, rigid support legs is that of storage, since the support legs are not usually foldable or detachable. Another problem is the difficulty of cleaning or properly maintaining such a burner apparatus, since corrosion of the iron or steel legs and burner is sometimes extensive, particularly when hot salt water is spilled from the cooker in the course of boiling seafood such as shrimp, crabs or crawfish. Accordingly, it is an object of this invention to provide a new and improved burner apparatus which is characterized by a fixed leg and two foldable or pivotable legs mounted on a central burner pipe by means of a fixed collar and fixed compression leg fittings, respectively, which leg fittings are further provided with fitting seals, the pivoting legs also having leg stops for centering the burner when the pivoting legs are deployed in functional configuration, to stabilize the legs while the burner apparatus is in use.

Another object of this invention is to provide a new and improved burner apparatus which is characterized by a fixed leg and two foldable legs, each of which foldable legs is rotatably mounted in a brass compression-type leg fitting which is secured to a cylindrical burner pipe. The burner pipe may be provided with a bottom collar ring or washer which is welded to the bottom end of the burner pipe, to facilitate optimum air flow into the burner chamber and a gas inlet line projects through the washer opening and terminates in the burner pipe.

Yet another object of this invention is to provide a new and improved folding burner apparatus which is characterized by a fixed leg and a pair of foldable legs provided with collars or fittings which are mounted in equally spaced relationship with respect to the fixed leg and each other on an interior burner pipe, which fittings are further provided with fitting seals adapted for engagement with the legs to selectively pivotally deploy the legs in functional and folded configuration. A leg stop is provided on each folding leg to maintain the foldable legs in approximately 120° spaced, deployed configuration and the upward-turned end of the burner pipe projects through the opening in a washer welded to the bottom of the burner pipe and receives a removable inlet line cap having a cap orifice for creating a flame of proper heat and proportions.

SUMMARY OF THE INVENTION

These and other objects of the invention are provided in a new and improved folding burner apparatus which is characterized by a centrally located, cylindrically-shaped burner pipe having a gas supply line and burner fitting or cap extending through a bottom washer which is welded to the bottom of the burner pipe. Three support legs are secured to the burner pipe, one in fixed relationship and the other two pivotally mounted by means of spaced compression tubing fittings, which dual legs are each rotatable with respect to the burner pipe and the fixed leg for selectively folding the support legs into a stored configuration against the fixed leg and extending the folding support legs into functional configuration. Leg stops are located on the folding legs and positioned to engage the burner pipe when the folding support legs are deployed in spaced, functional configuration with respect to the fixed leg. The legs and burner are constructed of corrosion-proof materials and the gas inlet line extends through the opening in a washer welded to the bottom of the burner pipe and is fitted with a copper or stainless steel cap having an orifice of suitable size to produce a flame of optimum proportions.

BRIEF DESCRIPTION OF THE DRAWING

The invention will be better understood by reference to the accompanying drawing, wherein.

DESCRIPTION OF THE PREFERRED EMBODIMENTS

Figure 1:
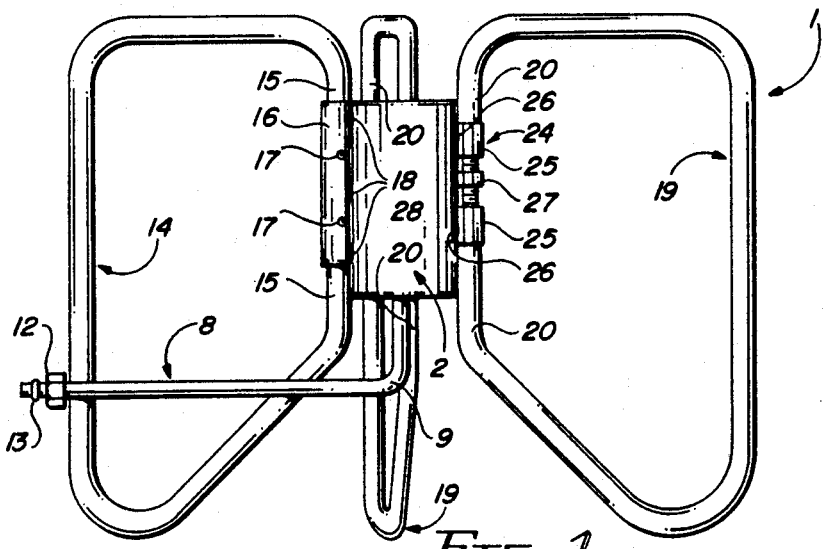
FIG. 1 is a front view of a preferred embodiment of the folding burner apparatus of this invention, illustrating a fixed leg and a pair of folding legs in functional, deployed position.
Figure 2:
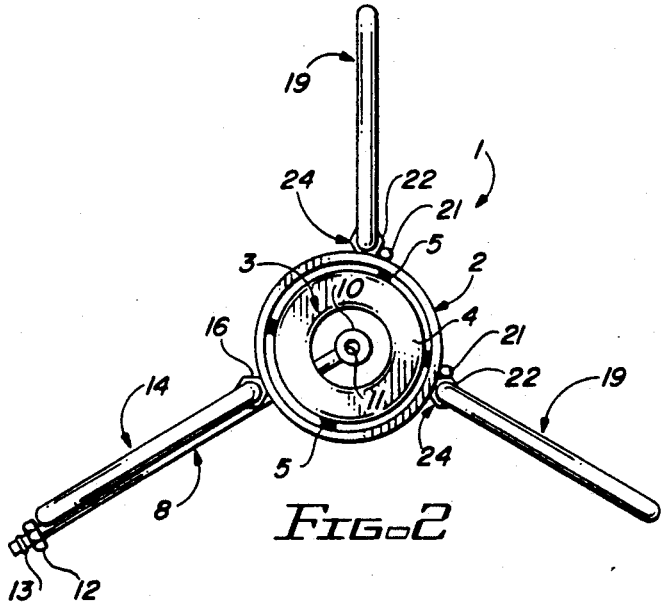
FIG. 2 is a top view of the folding burner apparatus illustrated in FIG. 1.
Figure 3:
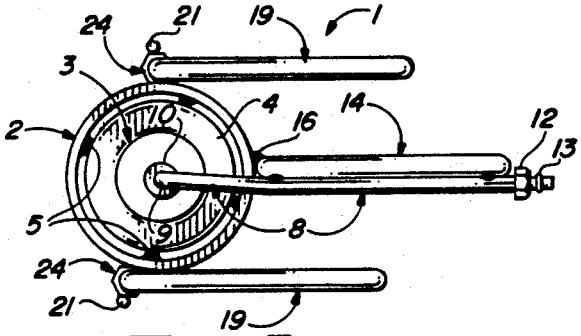
FIG. 3 is a bottom view of the folding burner apparatus illustrated in FIGS. 1 and 2, in folded configuration.

Referring to FIGS. 1–4 of the drawing, the folding burner apparatus of this invention is generally illustrated by reference numeral 1. The folding burner apparatus 1 is characterized by a vertical, cylindrically-shaped burner pipe 2, preferably constructed of copper and provided with a pipe bore or orifice 3 extending through the length thereof and with a washer 4, welded at the bottom end thereof by means of washer welds 5, as illustrated in FIGS. 2 and 3. A stainless steel gas inlet line 8 is welded to a stainless steel fixed leg 14, which is secured to the burner pipe 2 by means of the vertical fixed leg base 15, inserted in a fixed leg collar 16, welded to the burner pipe 2 at the spaced collar welds 18. The gas inlet line 8 includes an inlet line compression fitting 12 and fitting seal 13 at one end and is designed to channel gas from a source of supply (not illustrated) which is connected to the inlet line fitting 12, through the gas inlet line 8. The gas then flows through an inlet line bend 9 and through the cap orifice 3 of the fixed or removable copper or stainless steel cap 10, projecting through the opening in the washer 4. A match or igniter (not illustrated) is positioned near the top portion of the pipe orifice 3 in order to ignite gas which is introduced into the burner pipe 2 from the gas inlet line 8 and flowing into the pipe orifice 3 from the cap orifice 11, in conventional fashion. As illustrated in FIG. 1 of the drawing, the inlet line compression fitting 12 and fitting seal 13 are conventional in design and are located on the connecting end of the gas inlet line 8 spaced from the inlet line bend 9, in order to connect the gas inlet line 8 to a hose or conduit (not illustrated) connected to a source of gas such as a butane or propane bottle or other fuel supply (not illustrated).

Figure 6:
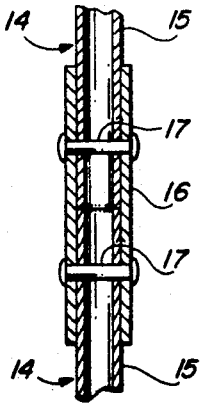
FIG. 6 is a side sectional view of the fixed leg and fixed leg collar elements of the folding burner apparatus.

As illustrated in FIGS. 1 and 6 of the drawing, in a most preferred embodiment of the invention the fixed leg 14 is secured to the burner pipe 2 by means of a vertical, tubular copper fixed leg collar 16, welded to the burner pipe 2 by means of spaced collar welds 18. The top and bottom ends of the vertical fixed leg base 15 segment of the fixed leg 14 are inserted in opposite ends of the fixed leg collar 16 and secured in alignment by means of collar rivets 17. The pivoting leg bases 20 of the two pivoting legs 19 are pivotally seated in corresponding conventional brass compression leg fittings 24, attached to the burner pipe 2 by means of collar welds 26 at the respective fitting collars 25 and deployed at about a 120° angle with respect to each other and the fixed leg 14 around the burner pipe 2, in order to provide a means for supporting a pot, pan or other cooking utensil (not illustrated) and applying heat to the cooking utensil.

Figure 5:
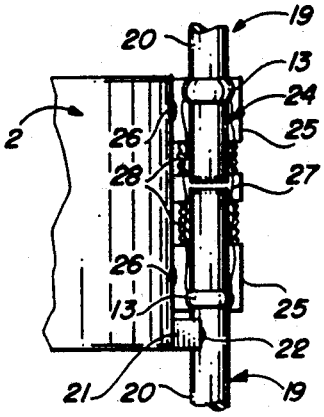
FIG. 5 is a side sectional view of preferred folding or pivoting support leg and leg fitting elements of the folding burner apparatus illustrated in FIG. 1.

Referring now to FIG. 5 of the drawing, the aligned top and bottom ends of the vertical pivoting leg base 20 of each pivoting leg 19 are pivotally secured inside the threaded brass nipple 27 of the respective compression leg fittings 24 by operation of brass fitting seals 13 and threaded brass fitting collars 25, threaded on the nipple threads 28. This pivoting relationship facilitates selective extension of the pivoting legs 19 into the 120° deployed configuration illustrated in FIGS. 1 and 2 and into the folded orientation illustrated in FIG. 3. This construction insures that when deployed as illustrated in FIG. 1, the fixed leg 14 and pivoting legs 19 of the folding burner apparatus 1 will support a cooking utensil or vessel (not illustrated) without tipping the cooking vessel.

Figure 4:
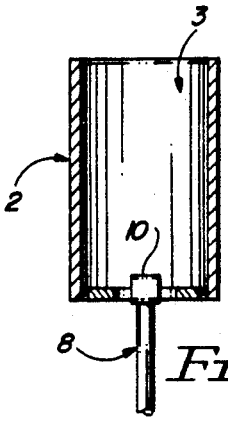
FIG. 4 is a sectional view of a preferred burner pipe element of the folding burner apparatus.

As further illustrated in FIGS. 2 and 4, in another preferred embodiment of the invention an inlet line cap 10 is fitted over the upwardly-projecting burner end of the gas inlet line 8 and is provided with a cap orifice 11 of suitable size to insure a flame of desired proportions. Accordingly, it will be appreciated that the inlet line cap 10 can be permanently fixed to the gas inlet line 8 or various inlet line caps 10, each having a cap orifice 11 of selected size, can be removably inserted on the burner end of the gas inlet line 8 to control the size and shape of the resulting flame. Typical cap orifice sizes range from about 1/16 to about 0.028 of an inch, in non-exclusive particular.

As further illustrated in FIGS. 2, 3 and 5 of the drawing, the pivoting legs 19 are each fitted with a tubular-shaped leg stop 21 by means of a stop weld 22, which leg stops 21 each engage the burner pipe 2 when the pivoting legs 19 are fully deployed as illustrated in FIGS. 1 and 2, in functional configuration at about a 120° angle with respect to each other and the fixed leg 14.

It will be appreciated by those skilled in the art that while those horizontal segments of the fixed leg 14 and pivoting legs 19 which support a cooking utensil (not illustrated) are illustrated as round in cross-sectional configuration, other geometric patterns and shapes can be incorporated, as desired. For example, ridges or grooves can be provided in these supporting segments to better secure the cooking utensil thereon. Furthermore, the fixed leg 14 and pivoting legs 19 can be constructed of any cast or otherwise fabricated metal which will maintain structural integrity at high temperatures. However, in a most preferred embodiment of the invention, stainless steel is a preferred material of construction. Furthermore, the burner pipe 2 is most preferably constructed of copper, along with the fixed leg collar 16, while the compression leg fittings 24 are conventional in design and are constructed of brass.

It will be further appreciated that while the burner pipe 2 can be fabricated of any desired size, a 2-inch, schedule 40 copper tube or pipe which is about 3 to 4 inches long and having pipe orifice 3 diameter of about 2 inches has been found to be ideal. The fixed leg 14 and pivoting legs 19 may typically be constructed of type 304 stainless steel having a diameter of ½ inch and a wall thickness of 0.049 inch. The pivoting leg bases 20 of the pivoting legs 19 are preferably inserted in standard ½ inch, brass compression leg fittings 24, the leg stops 21 are preferably constructed of copper or stainless steel, while the inlet line cap 10 and gas inlet line 8 are most preferably stainless steel.

Referring again to FIGS. 1-3 of the drawings, it will be appreciated by those skilled in the art that one element of a quick-disconnect fitting (not illustrated) can be fitted on the gas inlet line 8 in place of the inlet line compression fitting 12, for coupling with a corresponding element (not illustrated) of the quick-disconnect fitting attached to a gas supply hose (not illustrated). Furthermore, a tee fitting (not illustrated) can be provided on the gas inlet line 8 to facilitate supplying multiple units of the folding burner apparatus 1 from a single gas supply, as desired.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A folding burner apparatus for supporting a container and heating the contents of the container, comprising a burner disposed in substantially vertical orientation; a stainless steel washer mounted in the bottom of said burner; a fuel supply line having one end extending through the opening in said washer into the bottom of said burner; a fixed leg collar vertically fixedly carried by said burner and a fixed leg fixedly and vertically carried by said fixed leg collar; a pair of leg fittings vertically fixedly carried by said burner substantially equidistant from each other and from said fixed leg, respectively; and a pair of pivoting legs vertically carried by said leg fittings in pivotal relationship, whereby said pivoting legs are selectively pivotable in said leg fittings into a first folded configuration adjacent said fixed leg and a second deployed configuration extending from said fixed leg in spaced relationship.

2. The folding burner apparatus of claim 1 wherein said burner is copper, said fuel supply line is stainless steel, and fixed leg collar is copper, said leg fittings are brass and said fixed leg and said pivoting legs are stainless steel.

3. The folding burner apparatus of claim 2 wherein said fuel supply line is stainless steel, said leg fittings are brass compression fittings and further comprising:

(a) stainless steel leg stops carried by said pivoting legs, respectively, for engaging said burner pipe and preventing said pivoting legs from pivoting beyond a preselected position when said pivoting legs are pivoted into said deployed configuration.

(b) a copper cap fitted on said fuel supply line and an orifice provided in said cap for expelling fuel from said fuel supply line into said burner pipe; and (c) a brass fuel supply line compression fitting provided on said fuel supply line for engaging a source of fuel and connecting said fuel supply line to the source of fuel.

4. The folding burner apparatus of claim 1 further comprising a leg stop carried by each of said pivoting legs, respectively, for engaging said burner and preventing said pivoting legs from pivoting beyond a preselected position when said pivoting legs are pivoted into said deployed configuration.

5. The folding burner apparatus of claim 1 further comprising a copper cap fitted on said fuel supply line and an orifice provided in said cap for expelling fuel from said fuel supply line into said burner.

6. The burner apparatus of claim 1 further comprising a fuel supply line compression fitting provided on said fuel supply line for connecting said fuel supply line to a source of fuel.

* * * * *